United States Patent [19]

Pleil

[11] 4,065,689

[45] Dec. 27, 1977

[54] DUAL FILAMENT X-RAY TUBE

[75] Inventor: Viktor W. Pleil, Wheaton, Ill.

[73] Assignee: Picker Corporation, Cleveland, Ohio

[21] Appl. No.: 645,784

[22] Filed: Dec. 31, 1975

Related U.S. Application Data

[63] Continuation-in-part of Ser. No. 528,156, Nov. 29, 1974, abandoned.

[51] Int. Cl.[2] ..... H01J 35/10

[52] U.S. Cl. ..... 313/56; 313/57; 313/60; 250/401

[58] Field of Search ..... 313/56, 57

[56] References Cited

U.S. PATENT DOCUMENTS

| | | | |
|---|---|---|---|
| 2,121,631 | 6/1938 | Gross et al. | 313/56 |
| 2,146,900 | 2/1939 | Klinckman | 313/56 X |
| 3,649,861 | 3/1972 | Atlee et al. | 313/57 |
| 3,986,064 | 10/1976 | Oosterkamp et al. | 313/60 |

*Primary Examiner*—Rudolph V. Rolinec
*Assistant Examiner*—Darwin R. Hostetter
*Attorney, Agent, or Firm*—Watts, Hoffmann, Fisher & Heinke Co.

[57] ABSTRACT

A dual filament, rotary anode X-ray tube generates X-radiation of extraordinary uniform cross-sectional intensity by focusing a pair of electron flows on a target to produce partially overlapping focal spots. A pair of electron-emitting filaments are independently and adjustably excited for producing the flows of the electrons, each of which produces a line focus-type focal spot. The filaments are positioned in respective focusing cups which are configured and electrically biased to provide a degree of focal-spot overlap which produces a uniform distribution of electrons on the combined focal spots. The uniform electron distribution on the combined focal spots produces a uniform distribution of emitted X-radiation.

In another embodiment the electrons from the respective filaments are focused to provide radially aligned and adjacent inner and outer focal spots on the target. The flow of electrons to the outer focal spot is more heavily concentrated than the flow to the inward focal spot. This compensates for the reduced amount of time which the outer focal spot area is receiving electrons compared with the inner focal spot area. This compensation increases the maximum intensity of an X-ray beam that can be emitted by the rotary target.

9 Claims, 7 Drawing Figures

Fig. 1
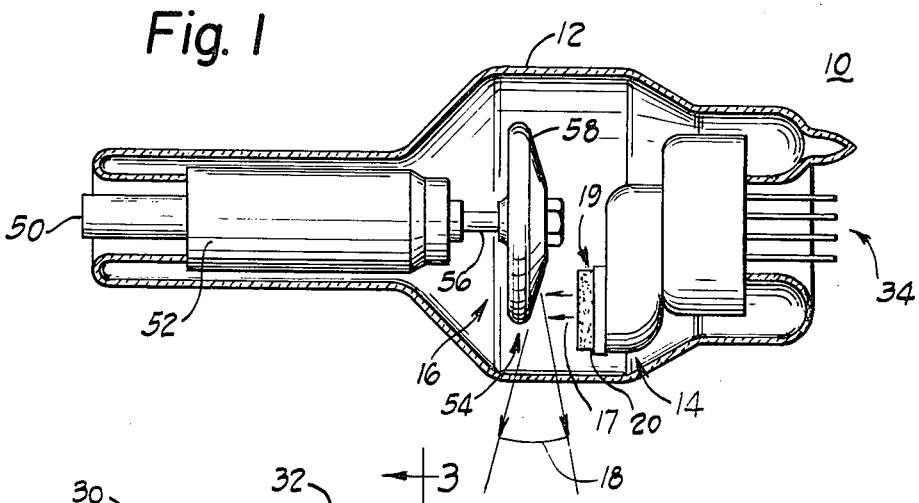
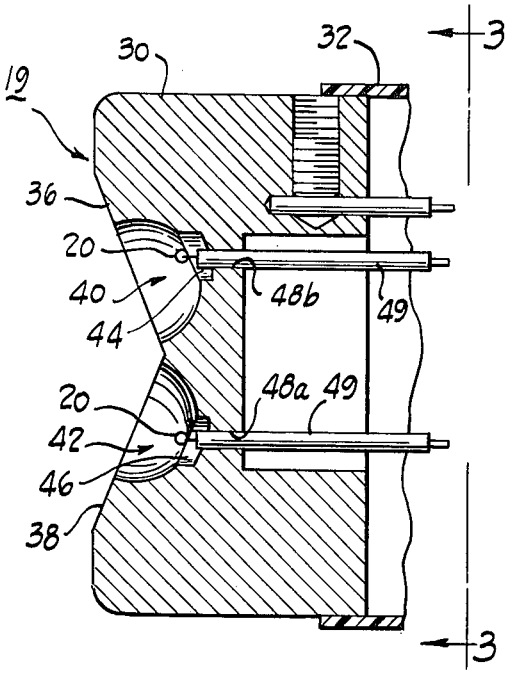
Fig. 2
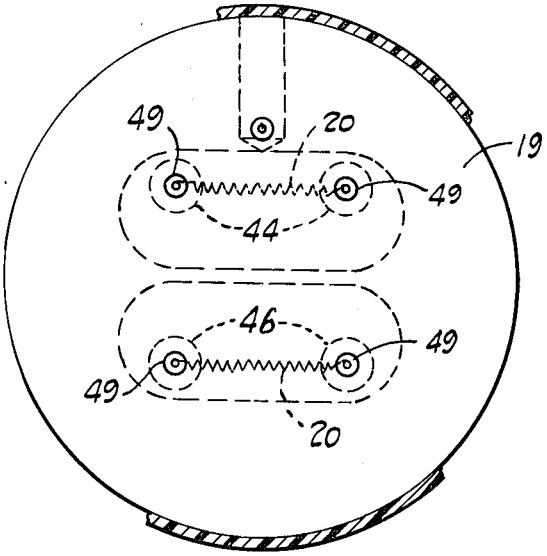
Fig. 3
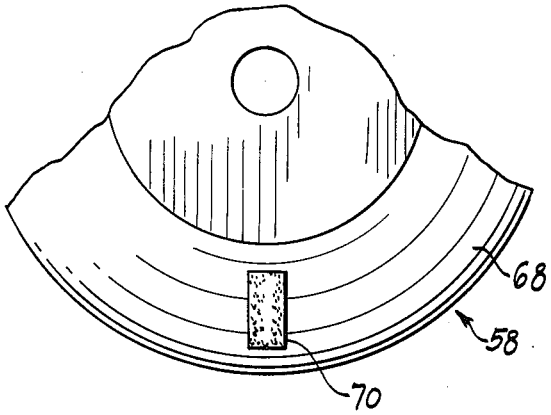
Fig. 4

DUAL FILAMENT X-RAY TUBE

REFERENCES TO RELEVANT AND RELATED PATENTS

PATENT APPLICATIONS

This application is a continuation-in-part of application Ser. No. 528,156, DUAL FILAMENT X-RAY TUBE, filed Nov. 29, 1974 now abandoned.

Atlee, et al., U.S. Pat. No. 2,340,363, CONTROL FOR FOCAL SPOTS IN X-RAY GENERATORS, issued Feb. 1, 1944 (here the FOCAL SPOTS patent).

Atlee, U.S. Pat. No. 2,686,884, SPACE CHARGE CONTROLLED X-RAY TUBE, issued Aug. 17, 1954 (here the SPACE CHARGE patent).

BACKGROUND OF THE INVENTION

1. Field of the Invention

This invention relates generally to X-ray tubes, and more particularly relates to dual focus X-ray tubes having a pair of simultaneously energized cathode filaments and to methods of dual filament tube operation.

X-radiation is used in a variety of examining procedures in diagnostic medicine. With these procedures a patient is positioned between an X-ray tube head and a detector, such as a sheet of X-ray film or a fluoroscopic device. An X-ray tube in the tube head emits a beam of X-rays which passes through the patient and impinges upon the detector. The X-ray beam produces, on the detector, a shadow image which is indicative of the condition of the internal structure of the patient and is used in the diagnosis of the condition of the patient.

In these examining procedures, the X-ray beam is desirably of uniform intensity in a plane which is normal to the beam axis. As the intensity becomes more uniform, the resolution, the amount and the quality of information obtained for diagnostic purposes increases. Accordingly, the X-ray tube should be structured and operated to produce an X-ray beam having as uniform intensity as possible.

X-ray tubes have an anode structure which defines a target. One or more cathodes, usually thermionic filaments, are provided for supplying electrons. A positive operating potential is applied between the cathode and anode structures for causing electrons released by the filaments to flow to and impinge upon the target. The target emits a beam of X-rays in response to the electrons.

The target is a surface positioned at an obtuse angle with respect to the path of electron flow. The electron-emitting area of the target is preferably configured in the shape of a rectangle which, due to the angular orientation of the target, appears as a square when viewed along the axis of the X-ray beam. Bombardment of this target area with appropriately distributed electrons produces an X-ray beam of uniform intensity which is capable of producing an image of high resolution. Ideally, an X-ray tube should be structured to produce a flow of electrons from the cathode structure to the target of the anode structure such that the target is bombarded with the electrons which are distributed uniformly, both longitudinally of and transversely of the target.

2. The Prior Art

There have been many prior proposals for overcoming the problems encountered in producing a uniformly distributed electron flow with a single filament X-ray tube. One such problem is that electron emission from a heated filament is uneven because the typical filament is unevenly heated with the center portion of the filament being heated to a greater extent than the end portions. There have been a number of proposals for overcoming, or at least limiting the effects of uneven electron emission. Some of these proposals have suggested a specially configured or constructed filament. A widely accepted and at least a partial solution to this problem is the use of an electrically biased focusing cup. Such a cup greatly improves the uniformity of electron flow longitudinally of the target by providing a mechanism for electrostatically focusing electrons. The electron optic characteristics of a focusing cup do not produce uniform distribution transversely of the target. Rather, electron impingement on the target is concentrated in two long, thin spaced and parallel regions. This focusing cup method of tube operation is described in detail in the above-referenced FOCAL SPOTS patent.

Another problem encountered with a hot filament X-ray tube is that of the so-called space charge limitation. As electrons are emitted from a heated filament, a space charge develops near the filament due to a residual accumulation of electrons which do not travel to the anode. Generally as more electrons are emitted from the filiment, the space charge increases for a given operating potential between the filament and the anode. One prior attempt at controlling the space charge has used an extra element, a grid electrode, in the X-ray tube. A positive voltage applied to the grid electrode tends to attract some of the residual electrons to reduce the space charge and allow increased electron flow. This technique is described in greater detail in the SPACE CHARGE patent.

Another limitation on the performance of an X-ray tube is the maximum temperature at which a hot filament may be properly operated. If the filament is operated in excess of its rated temperature, the structure of the filament is eventually weakened, substantially shortening the life of the filament and the tube. Because a thermionic filament produces electrons in proportion to its temperature, the temperature limitation inherently limits the production of electrons. Further, if a filament is heated beyond its rated temperature, it may distort and adversely affect the electron optic characteristics of the tube.

There have been prior attempts to produce electron flow of the desired characteristics in double filament X-ray tubes. These attempts have concurrently energized both filaments to provide two flows of electrons which impinge upon the target concurrently. The respective flows of electrons are focused either in nonoverlapping, laterally adjoining focal spot regions or in a wholly overlapping focal spot pattern. In either case, both flows of electrons strike the anode in patterns which together define a single X-ray-emitting target area.

In the nonoverlapping prior proposal, the combined focal spots are of a relatively large size and are bombarded by heavy flows of electrons to produce an X-ray beam of relatively high intensity. X-ray beams of high intensity are used in examination procedures, such as radiography, which require relatively large dosages of X-radiation. The individual heavy flows of electrons strike the target in radially transverse line focus patterns. Because the patterns were nonoverlapping, the overall electron distribution striking the target was nonuniform.

In the wholly overlapping pattern prior proposal, a smaller line focus-type focal spot was wholly contained within a large line focus-type spot. In this type of tube, two filaments and associated focusing mechanisms of differing configurations were required to produce the larger, outer and the smaller, inner spots. The differing configurations undesirably complicated the manufacturing requirements needed to produce a tube having an overall focal spot of uniform electron distribution.

Prior art, dual filament, X-ray tubes generally excited the filaments concurrently by connecting them to a common power source through separate filament transformers of hopefully equal output. Each filament transformer produced nonadjustable operating voltage to its associated filament. Theoretically, ideal and identical filaments would produce a pair of electron flows of the same distributional characteristics with this type of energizing circuit. As a practical matter, filaments are not ideal and identical. Even when similarly energized, each filament emits a slightly different electron distribution than the other filament pattern. Accordingly, prior dual filament tubes which utilized concurrent energization could not dependably provide, nor were they individually adjustable to provide, a pair of similarly distributed flows of electrons to the target area.

Although separately adjustable filament transformer circuits in dual filament tubes which do not concurrently energizc the filaments are known, it has not been known that extraordinary improvements in emission uniformity can be obtained by using separately adjustable filament transformer circuits in concurrently energized dual filament tubes.

Anode heat generation is another consideration in X-ray tube design. As electrons bombard the target, heat is generated. To prolong target life (and thus tube life), the temperature of the target must be kept below its rated value.

To increase the X-ray output for a given target size while not overheating the target, structures have been developed which lower the temperature of the electron-emitting target. X-ray tubes now commonly use a rotating anode which defines a rotating, frustoconical, target. The target is rotated at a high speed about an axis generally paralleling an extension of the axis of electron flow. Only a relatively small portion of the overall target area is within the electron path at a given time. The portions not in the electron path cool by radiation and conduction of the heat away from the target. Thus, the target area is constantly changing and any given portion of the target surface has time to cool as it is intermittently bombarded by the electrons. Accordingly, as compared with a fixed target, the target area in the electron path may be more heavily bombarded with electrons and can be operated at the higher temperature for a short period of time.

Prior rotating anode X-ray tubes have not provided optimum X-ray emitting efficiency for a given target area. As has been indicated, the conventional anode structure is frustoconically shaped with the electrons striking the target area at an angle. This produces an X-ray beam which has an axis transverse to the path of electron flow. For a given speed of anode rotation, radially outward regions of the target are moving at a faster velocity than inner regions. Because of this high rotational speed, the outward regions are bombarded for a shorter time interval than inner regions and are thus able to withstand a heavier electron bombardment without overheating. While the outer regions can withstand higher bombardment than inner regions, the intensity of electron flow has in the past been limited to a level which can be withstood by the radially innermost portions of a target area.

SUMMARY OF THE INVENTION

The foregoing and other shortcomings of the prior art are overcome by providing a concurrently energized, dual filament, X-ray tube which achieves optimum emission characteristics from a pair of selectively disposed focal spots on an X-ray emitting target. Two flows of electrons to the target are individually and independently controlled for allowing tube operating conditions to be adjusted until the optimum X-ray emission is obtained. The capability of independent adjustment additionally allows, for any given performance standard, the use of looser tolerances in cathode filament selection and in X-ray tube production during manufacture than has been possible previously. Conversely, higher performance standards are achievable from conventional dual focus tubes.

In accordance with the present invention a rotary anode X-ray tube is provided with cathode structure having a body which supports a pair of individually and separately excitable electron-emitting filaments. Power and control circuitry is provided for applying a tube operating potential between the anode and the cathode structure, for applying a focusing bias potential to the cathode body, and for controllably energizing the filaments. The respective filaments are concurrently energized to produce first and second flows of electrons to the anode structure. The specific configuration of the body and the applied focusing potential focuses the first and second flows of electrons into a pair of focal spots of the line focus type.

In a first embodiment, the filaments are preferably identical and their respective excitation levels are adjusted until electron emission from the filaments is substantially equal. This produces electron flows of similar electron distribution characteristics which produce individual focal spots of similar patterns. The focal spots are generally rectangular and have a higher distribution of electrons along the respective longitudinal margins. The focal spots are produced in partially overlapping relation with the degree of overlap, usually 50%, selected to provide, transversely of the target area, a relatively uniform combined distribution of electrons striking the combined focal spots or target area. The uniform distribution of electrons causes the target to emit uniformly distributed X-radiation. By coordinating the level of the distribution of electrons striking the target with respect to target characteristics, such as size, material, and rotational speed, an optimally efficient production of X-radiation is obtained.

In another embodiment, the configuration of the cathode body, the value of the focusing potential, and the value of the filament excitation potential cause the first and second flows of electrons to strike the target in radially disposed, inner and outer, contiguous, focal spots. The electron flow corresponding to the outer focal spot is adjusted to a higher intensity than the electron flow corresponding to the inner focal spot. Because the target is rotating, the higher electron intensity is applied to the outer focal spot for less time than the lesser intensity electron flow impinges upon the inner focal spot. This compensates for the speed differential of the focal spots and allows increased X-ray production from the combined focal spots without overheating.

Accordingly, a general object of the present invention is to provide a novel and improved multiple cathode, X-ray generating system which effectively produces an X-ray beam having improved intensity characteristics.

Other objects and a more complete understanding of the invention may be obtained upon referring to the following description of a preferred embodiment when taken in conjunction with the accompanying drawings.

BRIEF DESCRIPTION OF THE DRAWINGS

FIG. 1 is a schematic drawing of an X-ray tube in which the invention may be employed;

FIG. 2 is a cross-sectional view, on an enlarged scale, of the cathode structure in the X-ray tube of FIG. 1;

FIG. 3 is a fragmentary sectional view of the tube as seen from the plane indicated by the line 3—3 of FIG. 2 and showing the cathode structure in end elevation;

FIGS. 4–6 are plan views of a fragmentary portion of the anode on an enlarged scale showing focal spot patterns in the X-ray tube of FIG. 1; and, FIG. 7 is a schematic diagram of the X-ray tube of FIG. 1 and its excitation and control circuitry.

DESCRIPTION OF A PREFERRED EMBODIMENT

Figure 5:
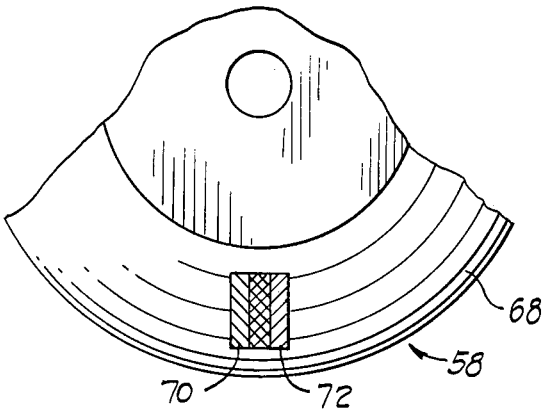

A rotating anode X-ray tube 10 constructed according to the present invention is shown in FIG. 1. The X-ray tube 10 includes a glass envelope 12 which defines an evacuated housing, an electron-emitting cathode structure 14, and a target-defining anode structure 16 mounted for rotation in the housing. An operating potential is applied between the cathode structure 14 and the anode structure 16, and the anode structure is caused to rotate by means of an externally applied magnetic field. The operating potential creates an electric field which is most negative near the cathode structure. A voltage potential is also applied across the cathode structure, causing the release of electrons 17 which are accelerated by the electric field to the target of the anode structure 16. The electrons impinge upon the anode structure 16 to produce X-radiation 18 which is directed through the envelope 12.

Referring to FIGS. 2 and 3, the cathode structure 14 is of the line focus type and includes a metal body structure 19. A pair of electron-emitting elements in the form of thermionic filaments 20 are supported by the body structure 19. The body structure 19 includes a focusing cup 30 which focuses the emitted electrons 17 and a support 32. The support 32 is supported from the envelope 12 as a mount for the cup 30.

A plurality of electrical inputs 34 are provided projecting from the right end of the envelope 12 as viewed in FIG. 1. The electrical inputs 34 include connections to the cup portion 30 to allow application of a focusing cup bias potential and of the operating potential, and include connections to the filaments 20 for energizing them to emit the electrons.

The focusing cup 30 has a re-entrant surface facing the anode structure 16. The re-entrant surface is in the form of a pair of planar face portions 36, 38. A pair of focusing cup recesses 40, 42 are respectively formed within the face portions 36, 38 for focusing the emitted electrons into specific patterns on the target of the cathode structure 16. The focusing cup recesses 40, 42 are of generally elongated shape and, in the preferred embodiment, have similar dimensions. Each recess 40, 42 has a pair of shallow bottomed bores 44, 46, which communicate with axially aligned passages **48*a*, 48*b*, respectively. The passages each receive an insulator 49. The insulators extend through the cup structure 30 to the slots 44, 46 to carry the inputs 34 which are connected to and carry the filaments 20**.

The electron-emitting filaments 20 are respectively mounted within the focusing cup recesses 40, 42. Each filament is comprised of a coil of thoriated tungsten or other suitable filament material which emits electrons when heated. The configuration of the recesses 40, 42 and the amount and polarity of the bias potential on the cup structure 30 determines the pattern of the electrons as they strike the anode structure 16.

The anode structure 16 is of the conventional rotary anode type. The anode structure 16 includes a shank 50, a rotor body 52, and an anode which is designated by the numeral 54. The shank 50 extends from the left end of the envelope 12 as viewed in FIG. 1 and allows application of the operating potential for producing the electric field between the cathode structure 14 and the anode structure 16.

A rotor stem 56 couples the anode 54 to the rotor body 52. The rotor body 52 is mounted for rotary movement about a longitudinal axis passing through the shank structure 50. The structure 52 functions as an armiture for an A.C. motor (not shown) and is caused to rotate at high speed, causing rotation of the anode 54 at high speed.

Referring to FIG. 4, the anode 54 is a disc 58 comprised of a refractory metal material and having a frustoconically-shaped perimetral target ring 68. The disc has its center portion coupled to the stem 56 and is positioned for electron bombardment. More specifically, the target ring is a focal spot portion transverse to and in the path of electron flow. As the disc rotates electrons strike a pair of regions, referred to as the focal spots, on the target ring causing the emission of X-rays. The emitted X-rays are directed through an X-ray transparent region in the envelope 12 for use, for example, in clinical diagnosis.

FIG. 4 shows a conventional rectangularly configured focal spot 70 produced by electrons impinging upon the target strip 68. The stippling of the focal spot represents the approximate density of the electrons as they strike the target strip 68. The density of the electrons 17 striking longitudinal marginal portions of the focal spot is substantially higher than the density inwardly from the marginal portions. This electron pattern is generally characteristic of a focal spot produced in a prior art, line focus, X-ray tube under normal operating conditions.

The X-radiation 18 emitted from the focal spot 70, when the electron density is non-uniform as shown in FIG. 4, has a nonuniform cross-sectional intensity which corresponds to the electron pattern. The emission of X-rays is higher along the longitudinal margins of the focal spot than from the central portion of the focal spot.

Concurrent dual filament operation produces an additional focal spot 72. In accordance with one embodiment of the present invention, the cathode structure 14 is configured to direct the flows of electrons 17 onto the target ring 68 to produce partially overlapping focal spots 70, 72. The bias potential and the configuration of the structure 30 is such that the regions of each focal spot having higher electron striking densities are superimposed upon the regions of lower electron striking densities. Under normal X-ray tube operating conditions with normal cup biasing potentials applied, it has been found that an overlap of approximately 50% in the transverse direction provides optimum results. As shown in FIG. 5, this arrangement produces an electron distribution over the combined area of the focal spots 70, 72 which is substantially uniform both transversely and longitudinally of the target. The resulting X-radiation 18 from the combined focal spots 70, 72 exhibits a substantially uniform cross-sectional intensity. The X-radiation having uniform cross-sectional intensity, produces high resolution of the subject under examination.

In addition to providing improved X-ray beam characteristics, the X-ray tube 10 according to the invention provides other advantages. The filaments 20 are operated at a substantially lower temperature to produce a given quantum of radiation than if a single filament is utilized. Also, so long as the target is not overheated, emission from the combined, partially overlapping, focal spots can nearly be doubled over that from a single filament.

Another advantage obtained from the described embodiment is that the limiting effects of space charge on the flow of electrons to the anode structure are minimized. Because the filaments 20 are operated at a relatively low emission level, the space charge build-up is minimal, and its effect becomes negligible.

Another overall advantage obtained from the described partially overlapping embodiment is that high X-ray emission levels may now be obtained at relatively low accelerating potentials between the anode and the cathode due to the relatively low emission levels from the individual filaments 20.

Figure 6:
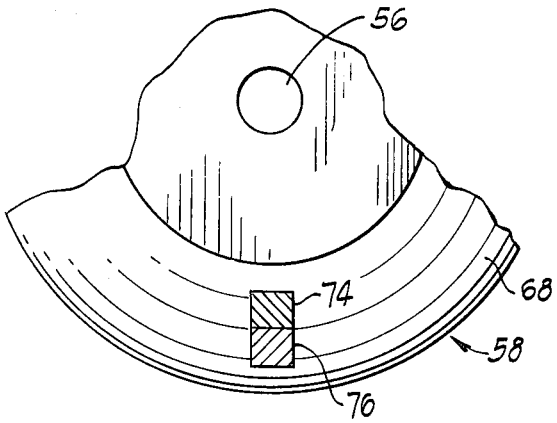

In accordance with another embodiment of the invention as shown in FIG. 6, the beams of electrons 17 impinge upon the target strip 68 in, generally rectangular, patterns to define a pair of focal spots 74, 76. The filaments 20, the shape of the recesses 40, 42 and the applied bias potential cause the focal spots 74, 76 to be produced in contiguous, radial alignment. One of the filaments 20 produces a relatively high number of electrons 17 flowing to the outermost focal spot 76. The other filament 20 produces a relatively low number of electrons which flow to the inner focal spot 74. With this arrangement of electrons striking the target ring 68, X-radiation 18 of higher intensity emanates from the spot 76 than from the spot 74.

The radial alignment pattern of the focal spots 74, 76 in FIG. 6 advantageously optimizes X-radiation emission from the target ring 68. As the anode 58 rotates about the axis of the stem 56 the outermost areas of the target ring 68 travel at a faster velocity than the innermost regions. Accordingly, the area of the outermost focal spot 76 is traveling at a faster velocity than the area of the focal spot 74. This means that the focal spot 76 receives electrons for a shorter time than the focal spot 74, and accordingly, the outermost focal spot 76 is able to withstand, without overheating, an electron beam of higher energy than the innermost focal spot 74. Thus, by operating the filaments 20 to produce a first flow of the electrons 17 of a lesser density to define the focal spot 74 and to produce a second flow of the electrons 17 of a higher electron density to define the focal spot 76, maximum X-ray emission is obtained from the target strip 68.

Figure 7:
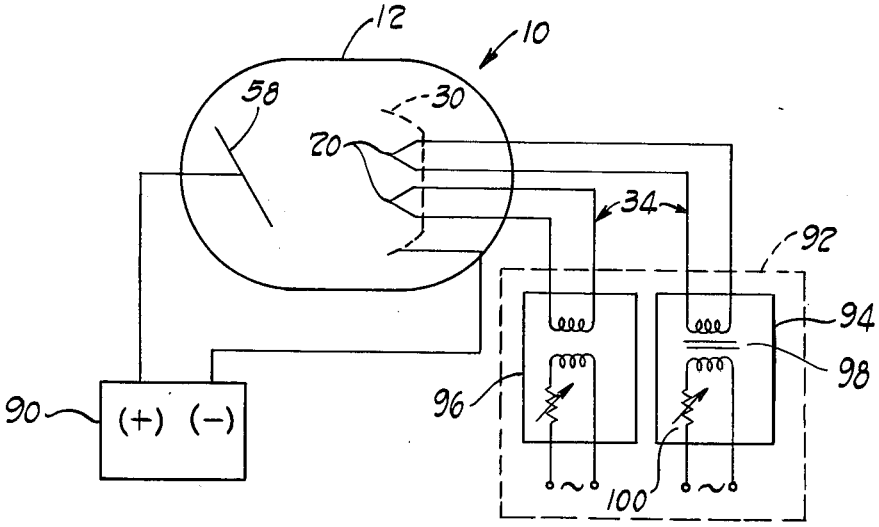

The X-ray tube 10 is shown in association with its power and control circuitry in FIG. 7. A tube power supply 90 and a filament power supply 92 are provided for providing operating power and bias potential to the tube 10. The tube power supply 90 is conventional and provides high tension operating potential between the body 19 of the cathode structure 14 and the disc 58 of the anode structure 16. The supply 92 provides individual and independent energization to the filaments 20 for effecting respective rates of electron emission which are individually controllable.

The filament power supply 92 includes a pair of separate power supplies 94, 96 which are coupled to the A.C. line voltage. At least one of the supplies is provided to produce a variable output voltage which is variable independent from the output voltage of the other supply.

The separate power supply 94 comprises a filament transformer 98 having its primary windings coupled to receive the A.C. line voltage and its secondary windings coupled to the X-ray tube 10. A control mechanism 100 is in the primary circuit of the filament transformer 98 and allows adjustment of the voltage output from the supply 94. The control mechanism 100 is functionally shown for purposes of illustration as a potentiometer but a variety of circuits and mechanisms could be utilized for the disclosed purpose of varying the output voltage of the transformer.

The other independent power supply 96 is preferably identical to the source 94. Alternatively, the source 96 may be a circuit commonly referred to in the art as a voltage stabilization circuit. When a voltage stabilization circuit is used, it produces a stabilized voltage output of the desired value to one of the filaments, and the independently adjustable source 94 allows the feature of the independent adjustment of the energization levels.

To produce the focal spots 70, 72 having substantially identical electron distributions, the flows of electrons from the filaments 20 must be substantially identical. Because inherent and unavoidable differences are usually present, filaments of identical construction, composition, and energization rarely produce identical electron emission patterns. The filament energizing circuitry 92 is utilized to individually adjust the filaments to produce substantially matched electron emission outputs. The electron emission characteristics of one of the filaments 20 is established using the source 96 and the source 94 is then adjusted until the output of the other filament 20 matches that of the first.

In addition to simplifying and improving operation of the X-ray tube 10, use of the filament energizing circuit 92 simplifies tube manufacture and lowers cost. By not requiring the filaments 20 to have matching electron emitting characteristics, looser tolerances may be utilized in both the selection of suitable filaments and in mounting the filaments 20 in the body structure 19 or alternately better performance can be obtained.

Although the invention has been described with a certain degree of particularity, it is understood that the present disclosure of the preferred embodiment has been made only by way of example. For example, other than line focus, rotary anode X-ray tubes producing rectangular focal spots could utilize the concepts herein disclosed. Other changes in the details of construction of the X-ray tube and in its operating circuitry also may be resorted to without departing from the spirit and the scope of the invention.

What is claimed is:

1. An X-ray tube comprising:

a. a cathode structure including means for controllably emitting first and second beams of electrons;

b. an anode structure which defines a target for emitting X-rays in response to the impingement of electrons;

c. high tension means for applying a tube operating voltage potential between the anode structure and the cathode structure to cause electrons from the respective beams to flow to and impinge upon the target region; and, d. said cathode structure including means for focusing the first and second beams of electrons onto first and second non-uniformly distributed spots of substantially the same size and configuration on said target and in partially overlapping relation to thereby provide a relatively uniform distribution of electrons striking the target area.

2. An X-ray tube as set forth in claim 1 wherein said anode structure comprises a rotatable target which is movable transversely of the flow of electrons.

3. An X-ray tube as set forth in claim 1 wherein the tube is a line focus tube and the means for focusing is constructed for producing the beams of electrons to strike the target region in elongated, axially parallel, partially overlapping spots.

4. An X-ray tube as set forth in claim 3 wherein said spots on the target region overlap each other by approximately 50 percent.

5. An X-ray tube as set forth in claim 3 wherein the means for focusing includes a metal body having first and second focusing cups, and the cathode structure comprises first and second thermionic filaments positioned within the first and second focusing cups for emitting the first and second beams of electrons.

6. An X-ray tube as set forth in claim 5 and including first and second independently adjustable filament transformer circuits for independently energizing the first and second thermionic filaments to emit the first and second beams of electrons to have substantially equal rates of emission.

7. The X-ray tube according to claim 1 wherein said cathode structure includes first and second substantially identically configured electron emitters which simultaneously emit the first and second beams of electrons at substantially equal rates of emission.

8. A method of producing X-rays in an X-ray tube comprising the steps of:

a. providing a target region which emits X-rays in response to bombardment with electrons;

b. concurrently producing first and second flows of electrons;

c. establishing a voltage potential adjacent the target region to cause the first and second flows of electrons to strike the target region; and, d. focusing the first and second flows of electrons to strike the target in first and second partially overlapping focal spots of similar, non-uniform electron distribution and of substantially the same size and configuration, the first and second partially overlapped focal spots providing an overall focal spot having a substantially uniform electron distribution.

9. A method of producing X-rays in a dual focus X-ray tube having first and second concurrently energizable electron emitting elements which produce first and second beams of electrons flowing to a target-defining anode, comprising the steps of:

a. energizing the first emitting element to produce the first beam of electrons having a first density and area characteristic;

b. energizing the second emitting element to produce the second beam of electrons;

c. adjusting the energization of the second emitting element independently from energization of the first emitting element until the second beam has a desired second density and area characteristic which substantially matches the first characteristic; and d. focusing the beams on the target of the anode in a partially overlapping relation to provide a combined focal spot having a relatively uniform electron-receiving density.

* * * * *